US006185764B1

(12) United States Patent
Merritt

(10) Patent No.: US 6,185,764 B1
(45) Date of Patent: Feb. 13, 2001

(54) MOTORIZED FOLDING BED

(76) Inventor: Bernard Merritt, 10716 Windledge Ave., Las Vegas, NV (US) 89134

( * ) Notice: Under 35 U.S.C. 154(b), the term of this patent shall be extended for 0 days.

(21) Appl. No.: 09/332,394

(22) Filed: Jun. 14, 1999

(51) Int. Cl.[7] ..... A47C 17/40
(52) U.S. Cl. ..... 5/136; 5/133; 5/164.1
(58) Field of Search ..... 5/133, 136, 137, 5/164.1, 165

(56) References Cited

U.S. PATENT DOCUMENTS

| | | | | |
|---|---|---|---|---|
| 580,359 | * | 4/1897 | Anthony | 5/133 |
| 940,038 | * | 11/1909 | Lyons | 5/136 |
| 1,105,203 | * | 7/1914 | Lavaway | 5/133 |
| 1,915,507 | * | 6/1933 | Wright | 5/136 |
| 2,067,136 | * | 1/1937 | Bridenbaugh | 5/133 |
| 2,116,698 | * | 5/1938 | Hall | 5/133 |
| 3,179,956 | | 4/1965 | Bennett . | |
| 3,458,877 | | 8/1969 | Edwards . | |
| 3,517,397 | | 6/1970 | Moore . | |
| 4,449,263 | | 5/1984 | Wilson et al. . | |
| 4,766,623 | | 8/1988 | Belhoffer et al. . | |
| 4,937,900 | | 7/1990 | Bridges . | |
| 5,446,932 | | 9/1995 | Voorhis . | |

FOREIGN PATENT DOCUMENTS

1341675 * 9/1963 (FR) ..... 5/133

* cited by examiner

*Primary Examiner*—Alexander Grosz
(74) *Attorney, Agent, or Firm*—Leonard Weiss

(57) ABSTRACT

In a first embodiment, a positioning shaft is fixedly connected to a frame of a folding bed. A switch is operable to cause a motor to rotate the positioning shaft in a manner that alternatively causes the frame to rotate to either a raised storage position or a lowered functional position. In a second embodiment, a power assembly and the frame have axes of rotation that are displaced from each other. A motor of the power assembly is coupled to an end of a threaded shaft that engages threads of an internally threaded sheath that is connected to the frame at a datum location. The frame is raised in response to a distance between axis of rotation of the power assembly and the datum location being increased. The frame is lowered in response to the distance being decreased. The distance is changed in response to a rotation of the threaded shaft.

3 Claims, 5 Drawing Sheets

MOTORIZED FOLDING BED

BACKGROUND OF THE INVENTION

1. Field of Invention

This invention relates to beds, and more particularly, is a folding bed that is alternatively raised and lowered in response to an operation of a switch.

2. Description of the Prior Art

A folding bed, often referred to as a Murphy bed, is usually comprised of a frame that supports a foundation and mattress. The folding bed is moveable from a vertical raised storage position to a horizontal lowered functional position and vice versa.

When in the raised position, the folding bed usually is disposed within an alcove of a wall or within a storage cabinet where it is concealed. In the lowered position, the folding bed appears to be a piece of furniture without extraordinary features.

The folding bed is frequently used in an environment, such as an apartment, where floor space may be marginally sufficient for a resident.

It should be understood that the weight of the folding bed is considerable. Because of the weight, counterbalancing springs are used to reduce the effort needed to raise and lower the folding bed. However for an elderly or handicapped individual, almost any effort is enervating. Accordingly, it is desirable to provide a motorized folding bed that obviates the effort.

The motorized folding beds of the prior art are cumbersome and expensive to produce. U.S. Pat. No. 3,517,397 of Moore, for example, discloses a folding bed that is raised and lowered by a motor that rotates a lead screw. The head of the '397 bed is coupled to a pair of guide tracks by guide members that are slidable within the tracks.

U.S. Pat. No. 4,449,263 discloses a motor bolted to a floor near the center of the foot of a folding bed. The motor is connected to a reciprocal drive arm that rotates the '263 bed about a pivot pin. Counterbalancing springs reduce the amount of force needed to rotate the '263 bed.

All folding beds of the prior art are comprised of a structural arrangement where raising and lowering creates friction between either two or more moveable structures or a moveable structure and a stationary structure. The friction is a source of undesired wear. There is a need for a motorized folding bed that is simple, reliable and inexpensive to produce and is a structure of a type that obviates excessive undesired wear.

SUMMARY OF THE INVENTION

An object of the present invention is to provide a frame of a folding bed that is alternatively raised from a lowered functional position and lowered from a raised storage position in response to an operation of a momentary switch.

According to the present invention, a motor is operable to cause a rotation of a frame of a folding bed about an axis of rotation.

In one specific embodiment, the motor is included in a rotatable power assembly that has an axis of rotation that is displaced from the axis of rotation of the frame. A threaded shaft is coupled to the motor. The threaded shaft engages threads within a sheath that is connected to the frame at a datum location whereby a rotation of the frame to either the raised storage or the lowered functional position causes a related rotation of the motor and all other components of the power assembly. The frame is raised in response to a distance between axis of rotation of the power assembly and the datum location being increased. The frame is lowered from a raised storage position in response to the distance being decreased. The distance is changed in response to a rotation of a threaded shaft.

The invention is a motorized folding bed that is simpler than motorized folding beds of the prior art. Additionally, in the event of a power failure, the folding bed is easily either raised or lowered manually.

Other objects, features, and advantages of the invention should be apparent from the following description of the preferred embodiment thereof as illustrated in the accompanying drawing.

DESCRIPTION OF THE EMBODIMENTS

Figure 1:
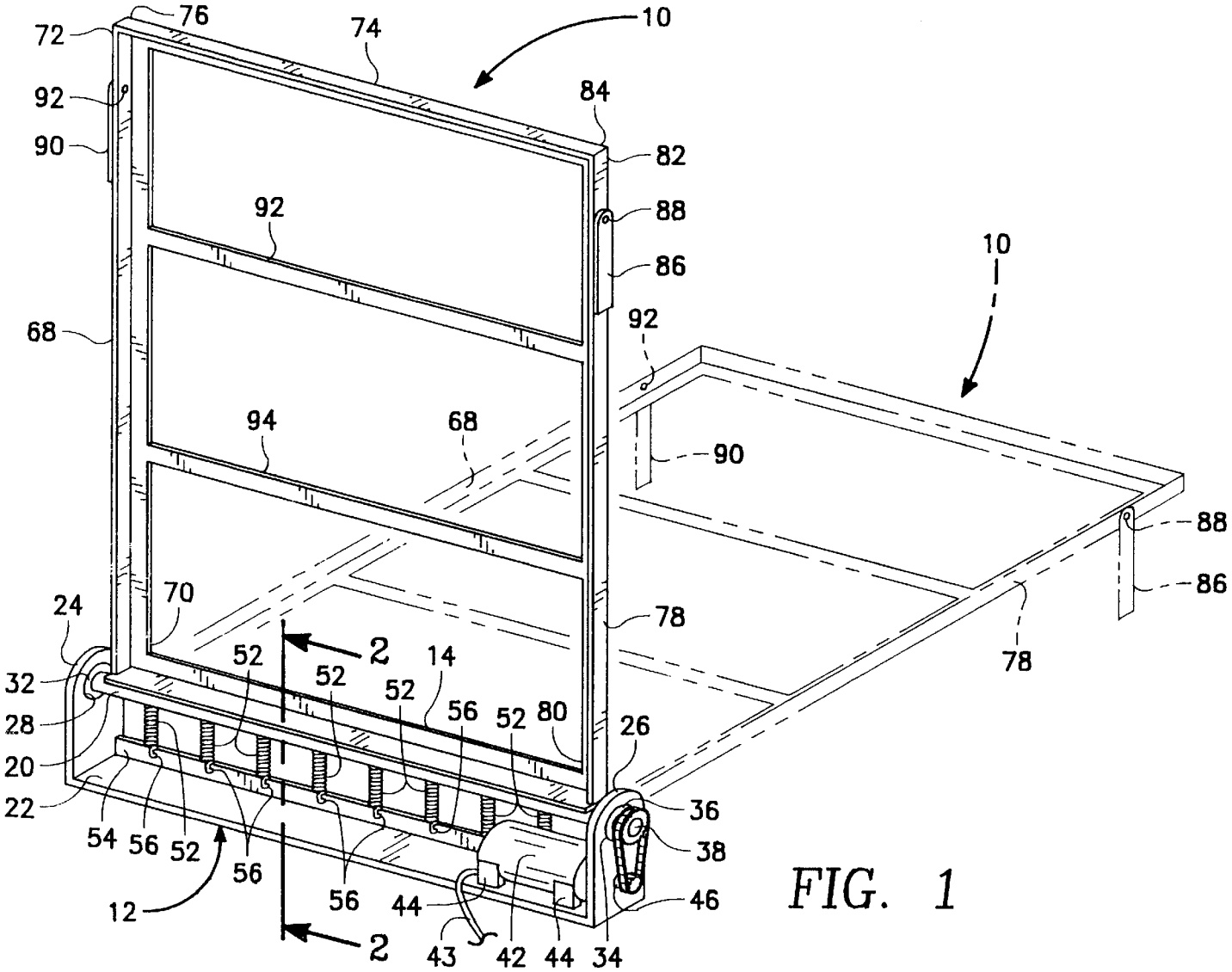
FIG. 1 is a perspective view of a first embodiment of the present invention.
Figure 2:
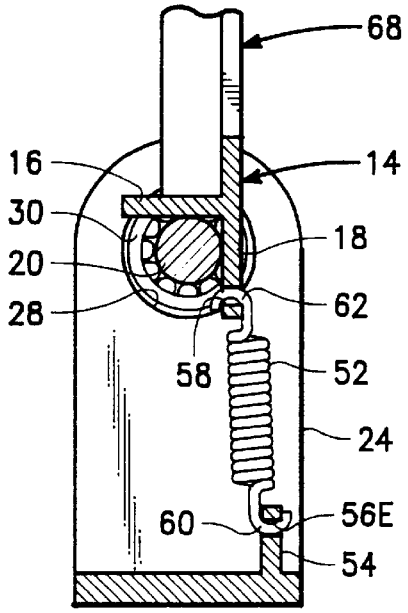
FIG. 2 is a section of FIG. 1 taken along the line 2—2 when a folding bed of FIG. 1 is in a raised position.
Figure 3:
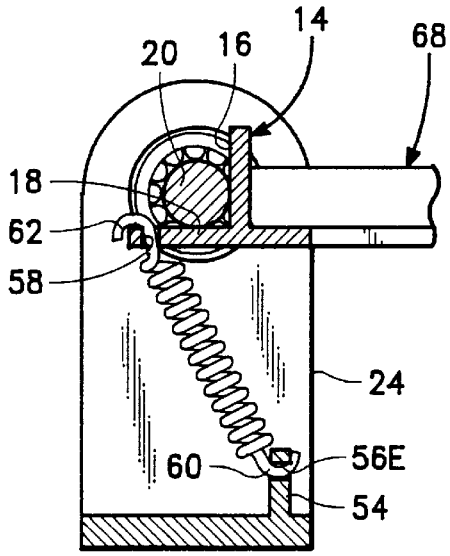
FIG. 3 is a section of FIG. 1 taken along the line 2—2 when a folding bed of FIG. 1 is in a lowered position.

As shown in FIGS. 1–3, a folding bed includes a frame 10 (FIG. 1) and a base 12. The frame 10 is shown in solid lines in a raised storage position and in broken lines in a lowered functional position. As explained hereinafter, the frame 10 is rotatable from the lowered position to the raised position and vice versa. The base 12 is stationary.

The frame 10 includes a transverse member 14 having a T shaped cross-section. The member 14 is the head of the folding bed. Surfaces 16, 18 (FIGS. 2 and 3) of the member 14 are fixedly connected in any suitable manner to a cylindrical positioning shaft 20.

Preferably, the base 12 is secured to a wall within an alcove 4 via L shaped brackets (not shown). Alternatively, the base 12 is secured to a wall of a storage cabinet. The use of the L shaped brackets obviates bolting the base 12 to a floor in accordance with the prior art.

The base 12 includes a horizontal panel 22 having ends that are integrally connected to similar vertical panels 24, 26. The panel 24 has a hole 28 therethrough wherein bearings are retained by a pillow block 30. An end 32 of the shaft 20 (FIG. 1 is journalled within the pillow block 30.

The panel 26 has a hole 34 therethrough wherein bearings are retained by a pillow block 36 that is similar to the pillow block 30. An end 38 of the shaft 20 is journalled within the pillow block 36.

Figure 4:
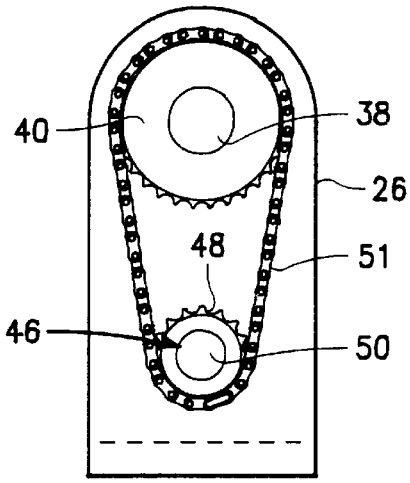
FIG. 4 is a plan view of a chain and sprocket arrangement in the embodiment of FIG. 1.

As best shown in FIG. 4, the end 38 extends from the pillow block 36 (FIG. 1). A sprocket 40 is fixedly mounted on the end 38. Hence, when the sprocket 40 rotates, the shaft 20 and the frame 10 correspondingly rotate. Accordingly, the frame 10 is rotatable about the axis of the shaft 20.

A motor 42 (FIG. 1) is seated within brackets 44 that are fixedly connected to the panel 22. The motor 42 is connected to an electrical power source (not shown) via a power cord 43 and a switch (not shown). Preferably the motor 42 is of a type that provides a motor shaft velocity comparable to a desired velocity of the raising and the lowering of the frame 10.

The switch has a push button that is manually depressed to cause a shaft 46 of the motor 42 to alternatively rotate in a clockwise or counterclockwise direction. When the switch is not depressed, the shaft 46 does not rotate. The switch is of a type well known to those skilled in the art as a momentary switch.

An end 50 (FIG. 4) of the shaft 46 extends through a hole in the panel 26. A sprocket 48 is fixedly mounted on the end 50. The sprocket 48 has a smaller diameter than the sprocket 40.

A chain loop 51 engages the sprockets 40, 48. Because the sprocket 48 has a smaller diameter that the sprocket 40, a greater amount of torque is available at the shaft 20 than at the shaft 46. Moreover, since the motor 42 is operable to rotate either clockwise or counter clockwise, the switch is operable to cause the raising or the lowering of the frame 10.

Preferably, a plurality of counterbalancing springs 52 are connected to the base 12 and the member 14. More particularly, the base 12 includes a transverse strip 54 that is integrally connected to the panel 22. The strip 54 has a plurality of holes 56 evenly spaced along its length. The strip 54 extends lengthwise between the panels 24, 26 and is perpendicular to the panel 22.

The member 14 has a plurality of holes therethrough, similar to the holes 56. The holes through the member 14 include a portion of an exemplary hole 58 (FIGS. 3 and 4). The holes 56 include a portion of an exemplary hole 56E. Ends 60, 62 of one of the springs 52 are respectively retained within the holes 56E, 58. All others of the springs 52 are connected to the member 14 and the strip 54 in a similar manner.

When the frame 10 is in the raised position, the springs 52 are relaxed. As the frame 10 is rotated from the raised position, tension in the springs 52 increases. Hence, tension in the springs 52 is a maximum when the frame 10 is in the lowered position.

Because of the springs 52, when the frame 10 is in the lowered position, the frame 10 is urged by the springs 52 towards the raised position. When the frame 10 is rotated from the raised position, the weight of the frame 10, a foundation and a mattress thereon urge the frame 10 towards the lowered position. Therefore, in the event of a power failure, the frame 10 is easily raised and lowered manually.

Figure 5:
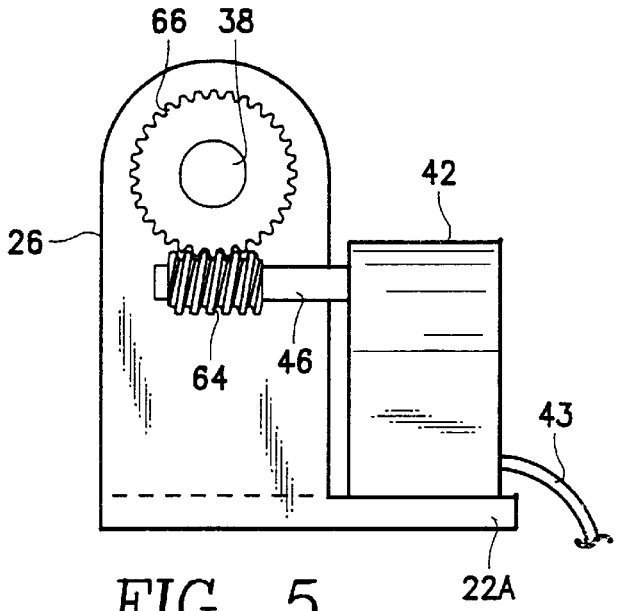
FIG. 5 is a plan view of an alternative to the chain and sprocket arrangement of FIG. 4.

As shown in FIG. 5, in an alternative embodiment, the motor 42 is mounted upon an extension 22A of the base 22. A worm gear 64 is fixedly mounted on the shaft 46. A spur gear 66 is mounted on the end 38. The worm gear 64 engages the gear 66, whereby rotation of the worm gear 64 causes the raising and lowering of the frame 10.

The frame 10 (FIG. 1), a type of structure that is well known in the art, includes a longitudinal member 68 that has an L shaped cross-section. The member 68 has an end 70 that is integrally connected to the member 14. Additionally, the member 68 has an end 72 that is integrally connected perpendicularly to a transverse member 74 at an end 76 thereof. The member 74 has the L shaped cross-section.

Similarly, the frame 10 includes a longitudinal member 78 that has the L shaped cross-section. The member 78 has an end 80 that is integrally connected to the member 14. Additionally, the member 78 has an end 82 that is integrally connected perpendicularly to the member 74 at an end 84 thereof. The member 78 is parallel to the member 68. The member 74 is the foot of the folding bed.

A support strip 86 is pivotally connected to the member 78 by a pivot pin 88 proximal to the member 74. Similarly, a support strip 90 is pivotally connected to the member 68 by a pivot pin 92 proximal to the member 74.

When the frame 10 is in the raised position, the strips 86, 90 are pivoted to positions parallel to the members 68, 78. When the frame 10 is in the lowered position, the strips 86, 90 are pivoted to positions that support the frame 10.

The frame 10 additionally includes transverse support members 92, 94 that are integrally connected to the members 68, 78. The members 92, 94 are elements that support the foundation and the mattress when they are placed upon the frame 10.

Figure 6:
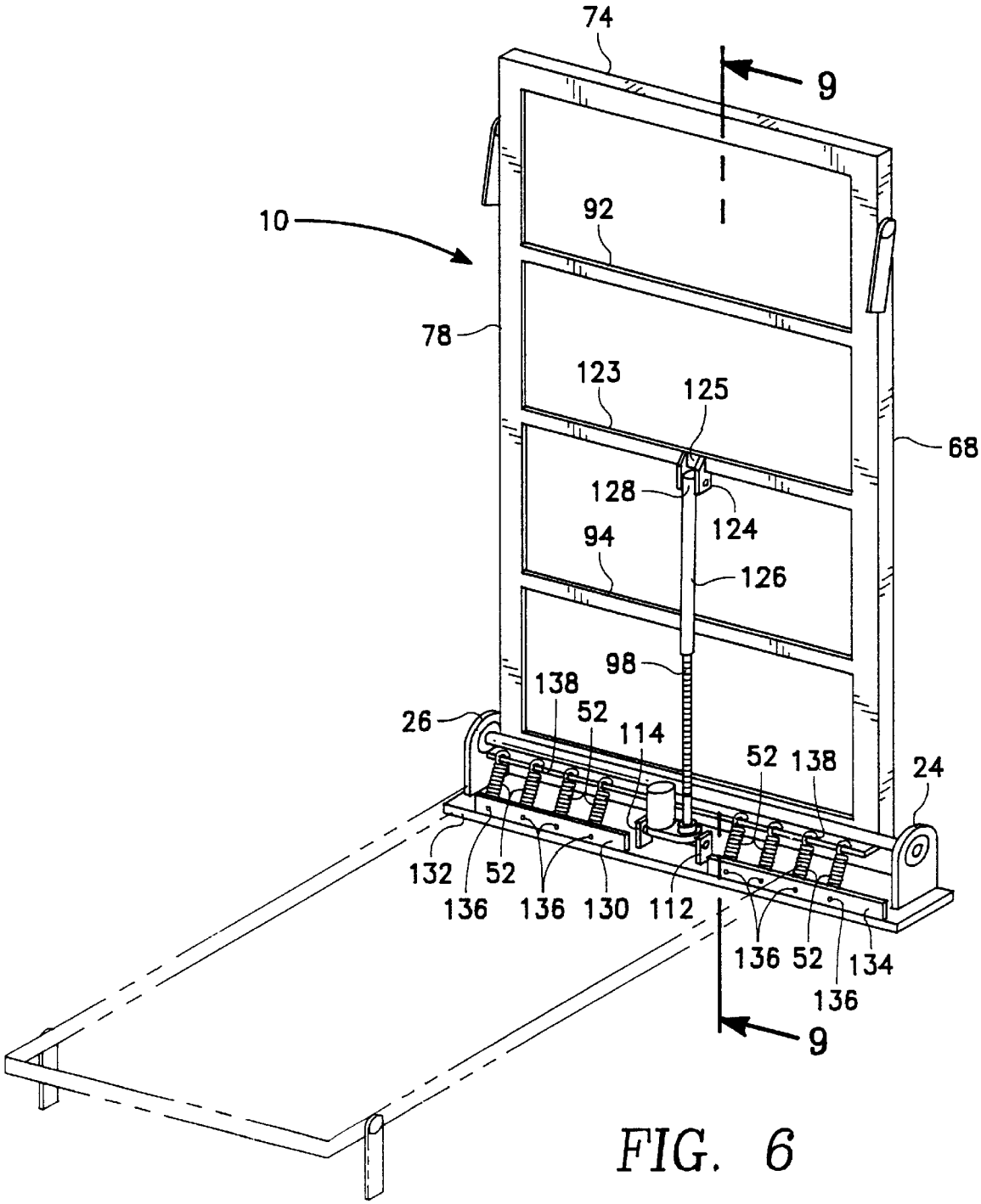
FIG. 6 is a perspective view of a second embodiment of the present invention.
Figure 7:
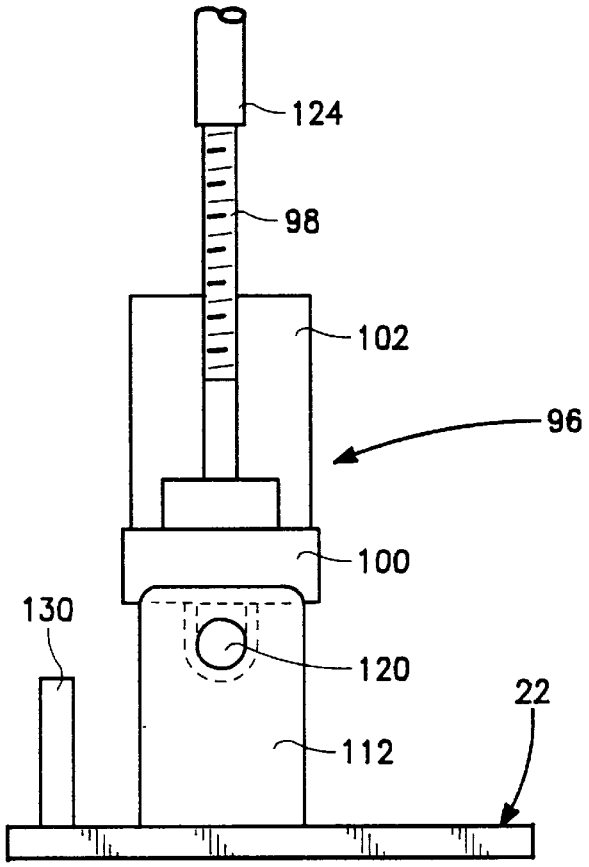
FIG. 7 is a side elevation of a motor and gear box in the embodiment of FIG. 6.
Figure 8:
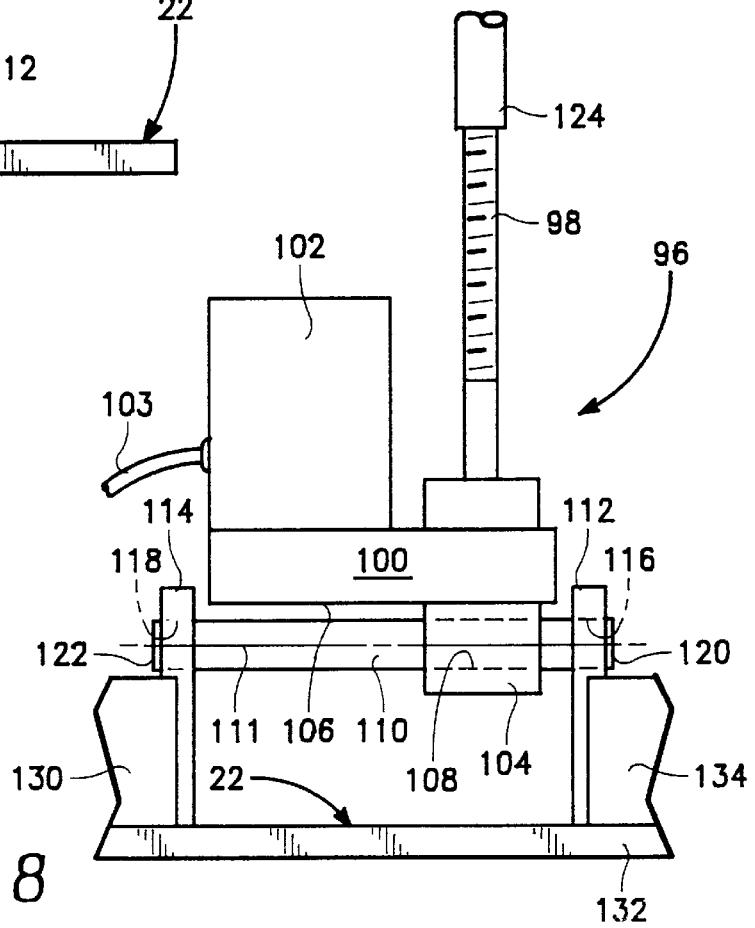
FIG. 8 is a front elevation of the motor and gear box of FIG. 7.

As shown in FIGS. 6–8, in a second embodiment of the present invention, a power assembly 96 includes a threaded shaft 98 having one end coupled through gears in a gear box 100 to a shaft (not shown) of a motor 102. A rotation of the shaft of the motor 102 causes a corresponding rotation of the threaded shaft 98. 20 The motor 102 is connected to an electrical power source (not shown) via a power cord 103 and a momentary switch (not shown) of a type described in connection with the first embodiment. Hence, the shaft of the motor 102 is alternatively rotatable in a clockwise and a counterclockwise direction.

The assembly 96 additionally includes a support block 104 that is fixedly connected to bottom surface 106 of the gear box 100. The support block 104 has a cylindrical hole 108 therethrough. A cylindrical shaft 110 that is coaxially disposed within the hole 108 is fixedly connected therein to the block 104. As explained hereinafter, the axis 111 of the shaft 110 is an axis of rotation of the assembly 96.

Brackets 112, 114 have holes 116, 118 respectively therethrough. Bearings are maintained within the hole 116 by a pillow block (not shown). In a similar manner, bearings are maintained within the hole 118. The brackets 112, 114 are mounted upon the panel 22.

The shaft 110 has ends 120, 122 that are journalled within the holes 116, 118, respectively. Therefore, the shaft 110 is rotatable within the holes 116, 118. Since the shaft 110 is fixedly connected to the block 104, the assembly 96 is rotatable about the axis 111.

Figure 9:
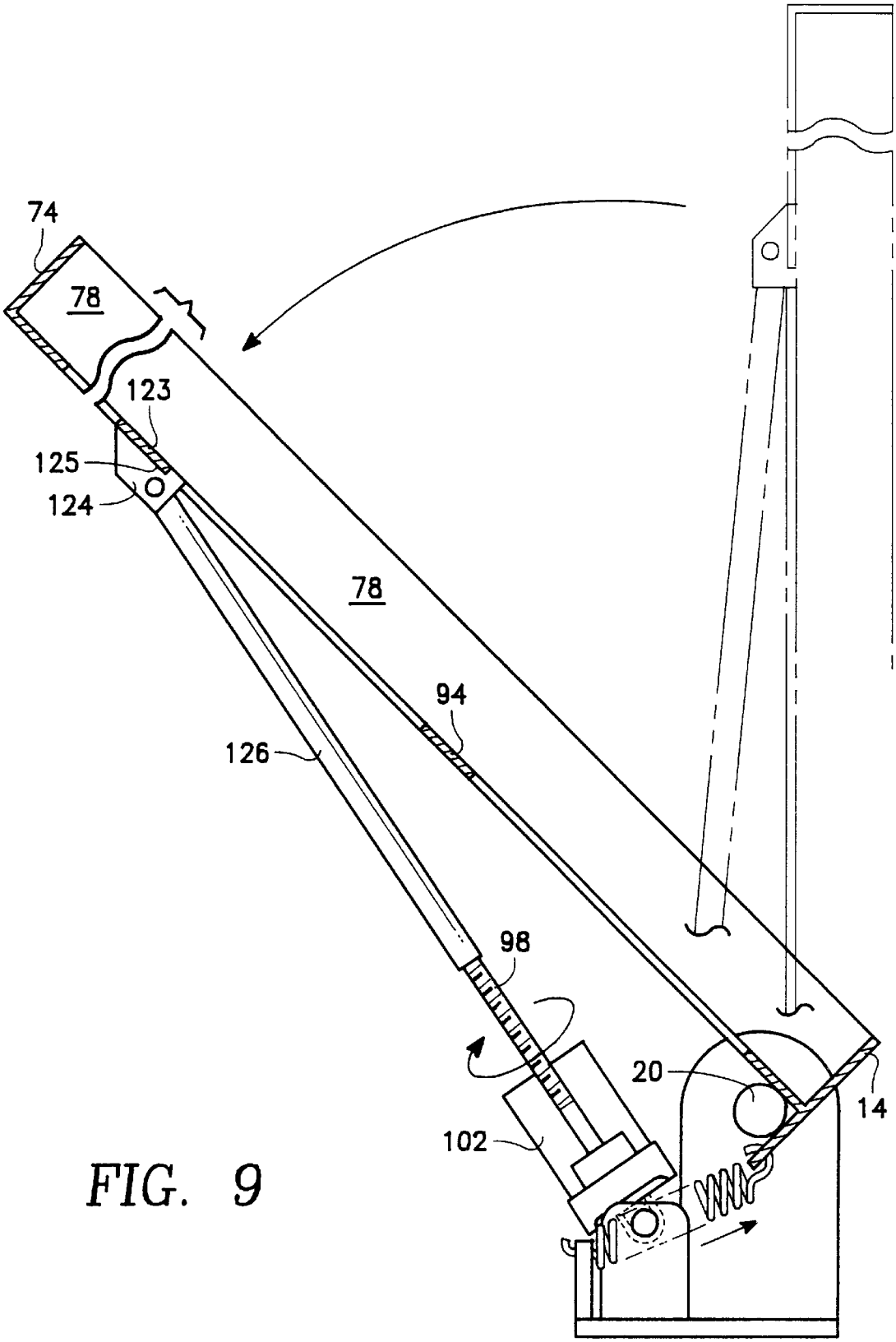
FIG. 9 is a section of FIG. 6 taken along the line 9—9.

As shown in FIG. 9, in this embodiment, the frame 10 additionally includes a transverse member 123 substantially midway between the members 92, 94. A bracket 124 is fixedly connected to the member 123 at a datum location 125 approximately midway between the members 68, 78. The purpose of the bracket 124 is described hereinafter.

The threaded shaft 98 engages threads within an internally threaded sheath 126. An end 128 of the sheath 126 is pivotally connected to the bracket 124. Because the threaded shaft 98 is engaged within the sheath 126 and the end 128 is connected to the bracket 124, a rotation of the frame 10 about the axis of the shaft 20 causes a rotation of the assembly 96 about the axis 111.

The use of the threaded shaft 98 to either lower or raise the frame 10 is predicated upon a displacement between the axis of rotation of the frame 10 and the axis 111. Because of the displacement, the distance between the datum location

125 (or any other location on the frame 10) and the axis 111 is least when the frame 10 is in the lowered functional position. The distance is greatest when the frame 10 is in the raised storage position.

Therefore there is a relationship between the distance and the position of the frame 10. This embodiment utilizes the threaded shaft 98 to implement the relationship.

Thus, when the frame 10 is in the lowered functional position, it is raised in response to the distance being increased; the increase is accomplished by the motor 102 rotating threaded shaft 98 in a counter clockwise direction. Conversely, when the frame 10 is in the raised storage position, it is lowered in response to the distance being decreased; the decrease is accomplished by the motor 102 rotating threaded shaft 98 in a clockwise direction.

A transverse strip 130 (FIGS. 6 and 8) is integrally connected to the panel 22 along an edge 132 thereof. One end of the strip 130 is proximal to the bracket 26; the other end is proximal to the bracket 114. Similarly, a transverse strip 134 is integrally connected to the panel 22 along the edge 132. One end of the strip 134 is proximal to the bracket 26; the other end is proximal to the bracket 112. Hence, there is a separation between the strips 130, 134. The separation prevents contact between the assembly 96 and the strips 130, 134 when the frame 10 is in the lowered functional position.

The strips 130, 134 have a plurality of holes 136 therethrough. The holes 136 are similar to the holes 56 in the first embodiment. the transverse member 14 has a plurality of holes 138 therethrough similar to the hole 58 in the first embodiment.

Ends of the springs 52 are retained within the holes 136, 138 in a manner similar to the retention of the springs 52 in the first embodiment. Preferably, the lead screw 98 is easily uncoupled from gears in the gear box 100 so that the frame 10 may be raised and lowered manually in the event of a power failure.

While the invention has been particularly shown and described with reference to embodiments thereof, it should be understood by those skilled in the art that changes in form and detail may be made therein without departing from the spirit and scope of the invention.

I claim:

1. A folding bed, comprising:

a frame;

a cylindrical positioning shaft that is fixedly connected to said frame, said frame being rotatable about the axis of said positioning shaft to either a raised storage position or a lowered functional position whereby the axis of said positioning shaft is the axis of rotation of said frame;

a motor;

a sprocket that is fixedly mounted on the shaft of said motor;

a sprocket that is fixedly mounted on said positioning shaft; and a chain loop that engages said sprockets.

2. The folding bed of claim 1 wherein said sprocket mounted on said motor shaft has a smaller diameter than said sprocket mounted on said positioning shaft.

3. A folding bed, comprising:

a frame;

a cylindrical positioning shaft that is fixedly connected to said frame, said frame being rotatable about the axis of said positioning shaft to either a raised storage position or a lowered functional position whereby the axis of said positioning shaft is the axis of rotation of said frame;

means for rotating said frame about said axis of rotation;

a stationary member;

a pillow block connected to said stationary member, said positioning shaft being journalled within said pillow block; and a coil spring having one end connected to said frame and the other end connected to said stationary member, said spring being relaxed when said frame is in said raised position and in tension when said frame is in said lowered position.

* * * * *